US009655806B2

(12) United States Patent
Naucke

(10) Patent No.: US 9,655,806 B2
(45) Date of Patent: May 23, 2017

(54) MULTIPLE USE AMBULATORY DEVICE

(71) Applicant: Leslie R Naucke, Corinth, MS (US)

(72) Inventor: Leslie R Naucke, Corinth, MS (US)

( * ) Notice: Subject to any disclaimer, the term of this patent is extended or adjusted under 35 U.S.C. 154(b) by 89 days.

(21) Appl. No.: 14/585,867

(22) Filed: Dec. 30, 2014

(65) Prior Publication Data

US 2016/0184167 A1 Jun. 30, 2016

(51) Int. Cl.

*A61H 3/04* (2006.01)
*A61G 5/02* (2006.01)
*A61G 5/10* (2006.01)

(52) U.S. Cl.

CPC ..... *A61H 3/04* (2013.01); *A61G 5/02* (2013.01); *A61G 5/10* (2013.01); *A61G 5/1008* (2013.01); *A61G 5/1013* (2013.01); *A61H 2003/046* (2013.01); *A61H 2201/0107* (2013.01); *A61H 2201/1633* (2013.01)

(58) Field of Classification Search

CPC ... A61H 3/04; A61G 5/02; A61G 5/10; A61G 5/1005; A61G 5/1035; A61G 5/1037; A61G 5/1075

See application file for complete search history.

(56) References Cited

U.S. PATENT DOCUMENTS 1,448,783 A * 3/1923 Blewitt ..... A61H 3/04 135/67
2,556,121 A * 6/1951 Thomas ..... A61G 5/10 280/304.1
2,596,055 A * 5/1952 Thomas ..... A61G 5/14 280/304.1
2,855,979 A * 10/1958 Hubbard ..... A61G 5/14 280/249
3,354,893 A * 11/1967 Schmerl ..... A61H 3/04 135/67
3,398,974 A * 8/1968 Edwards ..... A61G 5/14 280/304.1
3,708,182 A * 1/1973 Markiel ..... A61H 3/04 280/288.4
3,999,778 A * 12/1976 Markiel ..... A61G 5/14 280/304.1
5,320,122 A * 6/1994 Jacobson, II ..... A61H 3/04 135/66
5,380,262 A * 1/1995 Austin ..... A61H 3/04 280/647
5,419,571 A * 5/1995 Vaughan ..... A61G 5/10 280/250.1
5,451,193 A * 9/1995 Pickard ..... A61G 5/00 280/250.1
5,558,358 A * 9/1996 Johnson ..... A61G 5/00 280/250.1
5,741,020 A * 4/1998 Harroun ..... A47D 13/04 280/42
6,217,057 B1 * 4/2001 Kitchen ..... A61G 5/00 280/47.38

(Continued)

*Primary Examiner* — J. Allen Shriver, II
*Assistant Examiner* — Steve Clemmons
(74) *Attorney, Agent, or Firm* — Douglas E. Warren

(57) ABSTRACT

A multiple use ambulatory device for use in the mobilization and transport of patients that are unable to move without the aid of a medical device where the device and configured to be either a standard walker without a seat, a walker that has a seat located to the rear of the walking patient, or a wheelchair for use in transporting a patient unable to stand without assistance.

16 Claims, 5 Drawing Sheets

(56) References Cited

U.S. PATENT DOCUMENTS

| | | | | |
|---|---|---|---|---|
| 6,338,493 | B1 * | 1/2002 | Wohlgemuth | A61G 5/00 135/66 |
| 6,467,797 | B1 * | 10/2002 | Lofy | A61G 5/10 280/647 |
| 6,921,101 | B1 * | 7/2005 | Lauren | A61G 5/00 135/67 |
| 7,669,863 | B2 * | 3/2010 | Steiner | A61G 5/14 280/250.1 |
| 8,584,689 | B2 * | 11/2013 | Catton | A61H 3/04 135/67 |
| 8,714,171 | B1 * | 5/2014 | Haygood | A61G 7/1038 135/66 |
| 8,936,262 | B2 * | 1/2015 | Nabeta | A61H 3/04 135/67 |
| 8,998,244 | B2 * | 4/2015 | Purdue | A61G 5/022 280/647 |
| 9,233,047 | B2 * | 1/2016 | Jordan | A61H 3/00 |
| 2015/0320633 | A1 * | 11/2015 | Jacobs | A61H 3/04 297/6 |

* cited by examiner

MULTIPLE USE AMBULATORY DEVICE

CROSS REFERENCE TO RELATED APPLICATIONS

Not applicable.

STATEMENT REGARDING FEDERALLY SPONSORED RESEARCH

Not Applicable.

BACKGROUND

This section provides background information related to the present disclosure which is not necessarily prior art.

1. Field of Technology

The present disclosure relates to a multiple use ambulatory device that can be configured for multiple uses in the care of medical patients who need ambulatory assistance.

2. Background of the Technology

In the medical industry there are often occasions where patients are unable to walk or move about without some type of ambulatory assistance. The type of actual mobility impairment varies with the medical condition of any single patient. In some cases, the impairment may be permanent as a result to bodily damage caused by disease or injury. In other cases, the impairment may be long term, but temporary. In that situation, the need for ambulatory assistance can change as the patient recovers. In yet other cases, the impairment of a patient can be better or worse on almost a daily basis. In those cases, a patient may not be able to get out of bed one day, but be able to barely walk with great assistance the next day, only to be able to walk with little assistance on the following day. Then, due to the specific condition that patient may have, the patient relapses into a less mobile state and may again need a wheelchair simply to be moved from place to place.

Currently, the most prevalent type of ambulatory assistance is in the form of a "walker." Walkers of this type generally have two side frames and a front frame connected together to form a horizontal U-shaped tubular frame. The patient stands erect within the U-shape and moves forward by means of wheels that are mounted to the bottom of some of the frame's tubular structure. In some cases, wheels are mounted to one part of the frame and rubber feet that provide gripping assistance to a floor covering may be mounted onto other parts of the tubular frame. To assist in the stopping of the walker when it is in motion, a set of hand brakes are normally mounted on the frame in a position that makes the activation of the hand brake by the patient convenient and safe.

Although helpful when the patient can stand and walk with the assistance of the walker, if the patient must rest upon the seat, the patient will suddenly be facing in the opposite direction from that in which the patient had originally been proceeding. More importantly, it is extremely difficult to transport the patient in any direction because once the patient is seated on the walker seat, the walker cannot be moved.

If the patient is able to get out of bed, but is unable to stand, the patient must be moved with a wheelchair. Wheelchairs are normally equipped with hand grips on the back of the chair for use by a care giver to push or pull the wheelchair to transport the patient to different locations. Unfortunately, the standard wheelchair cannot be adapted to function as a walker if the patient is capable of standing and perhaps walking with the assistance of a walker.

When a seat is included in the design of the current walker devices, the seat is mounted onto the walker in a position that is directly in front of the patient as the patient is walking forward using the walker. The apparent purpose of such seats is to provide the patient with the capability of sitting on the seat when the patient gets tired or is unable to continue walking with the walker. That seat location, however, is of no benefit to a patient who has lost balance and is falling backward away from the walker. In that situation, the patient will fall backward onto the floor and could easily suffer additional injury.

What is needed is a three-in-one type multiple use walker that can be adapted to provide: (1) a seat behind the patient when the patient is walking in order to catch the patient if the patient falls backward, (2) a wheelchair configuration for use by the patient when the patient can move, but is not able to stand, and (3) a walker that can be used by a patient that has better ability to stand and remain balanced without the need for catching the patient in the event of a fall backward from the walker.

BRIEF SUMMARY OF VARIOUS PREFERRED EMBODIMENTS OF THE INVENTION

This section provides a general summary of the disclosure, and is not a comprehensive disclosure of its full scope or all of its features.

In accordance with the various embodiments of the present invention, a new multiple use ambulatory device is disclosed herein that can be configured to be a single three-in-one device that can provide assistance as a wheelchair, a walker with a rear-placed seat, and a simple lightweight walker that has no seat.

The invention summarized above comprises the constructions hereinafter described, the scope of the invention being indicated by the subjoined claims. Further areas of applicability will become apparent from the description provided herein. The description and specific examples in this summary are intended for purposes of illustration only and are not intended to limit the scope of the present disclosure.

BRIEF DESCRIPTION OF THE SEVERAL VIEWS OF THE DRAWINGS

In the accompanying drawings in which several of various possible embodiments of the invention are illustrated, corresponding reference characters refer to corresponding parts throughout the several views of the drawings in which.

Corresponding reference numerals indicate corresponding steps or parts throughout the several figures of the drawings.

Figure 1:
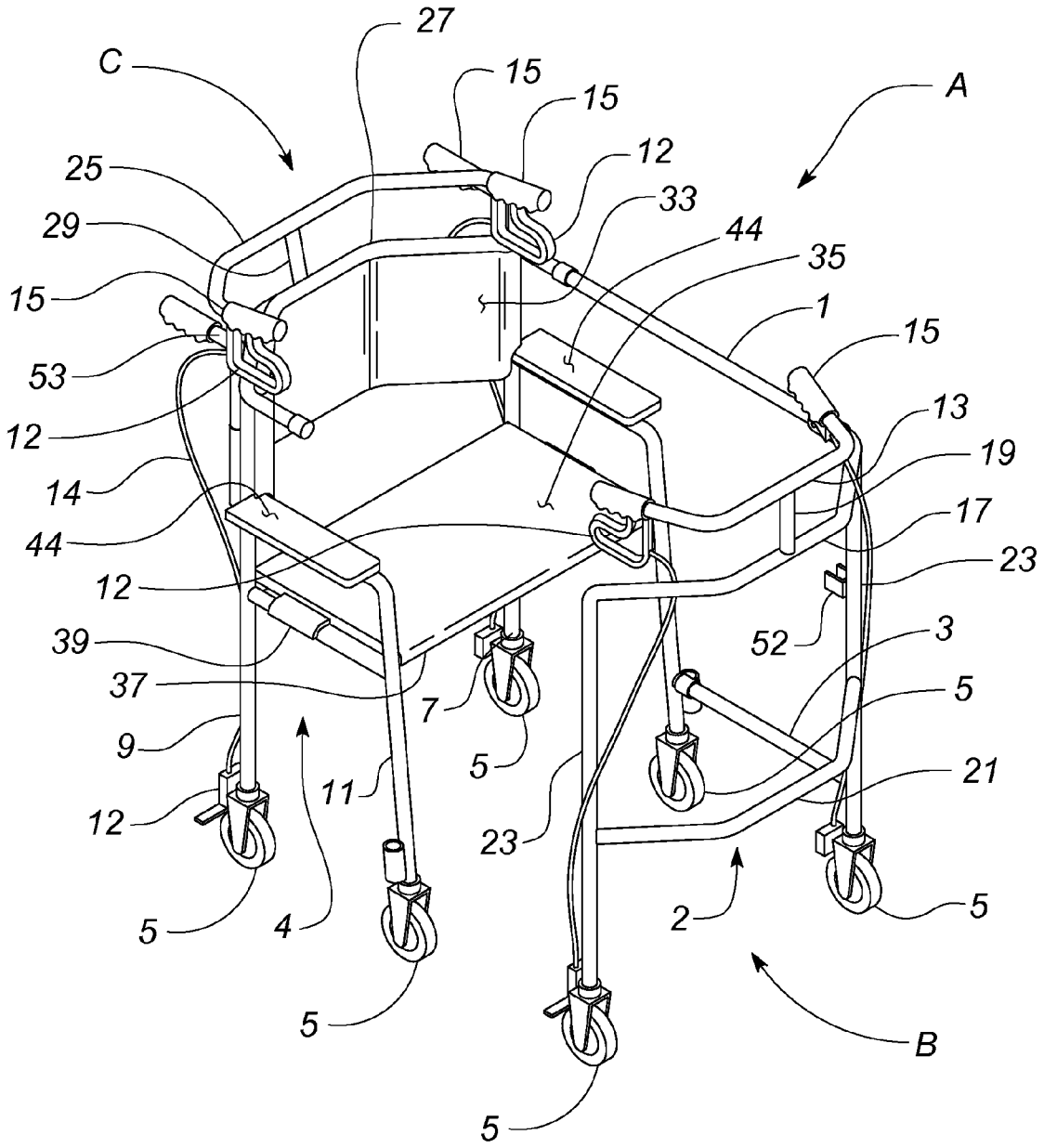
FIG. 1 shows a front perspective view of one embodiment of the present invention.

The drawings described herein are for illustrative purposes only of selected embodiments and not all possible implementations, and are not intended to limit the scope of the present disclosure.

More specifically, although one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE PREFERRED EMBODIMENT OF THE INVENTION

In the following description, numerous specific details are set forth such as examples of some preferred embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

A preferred embodiment of the present invention is illustrated in the drawings and figures contained within this specification. More specifically, certain preferred embodiments of the present invention are generally disclosed and described in FIGS. 1 through 8.

Figure 2:
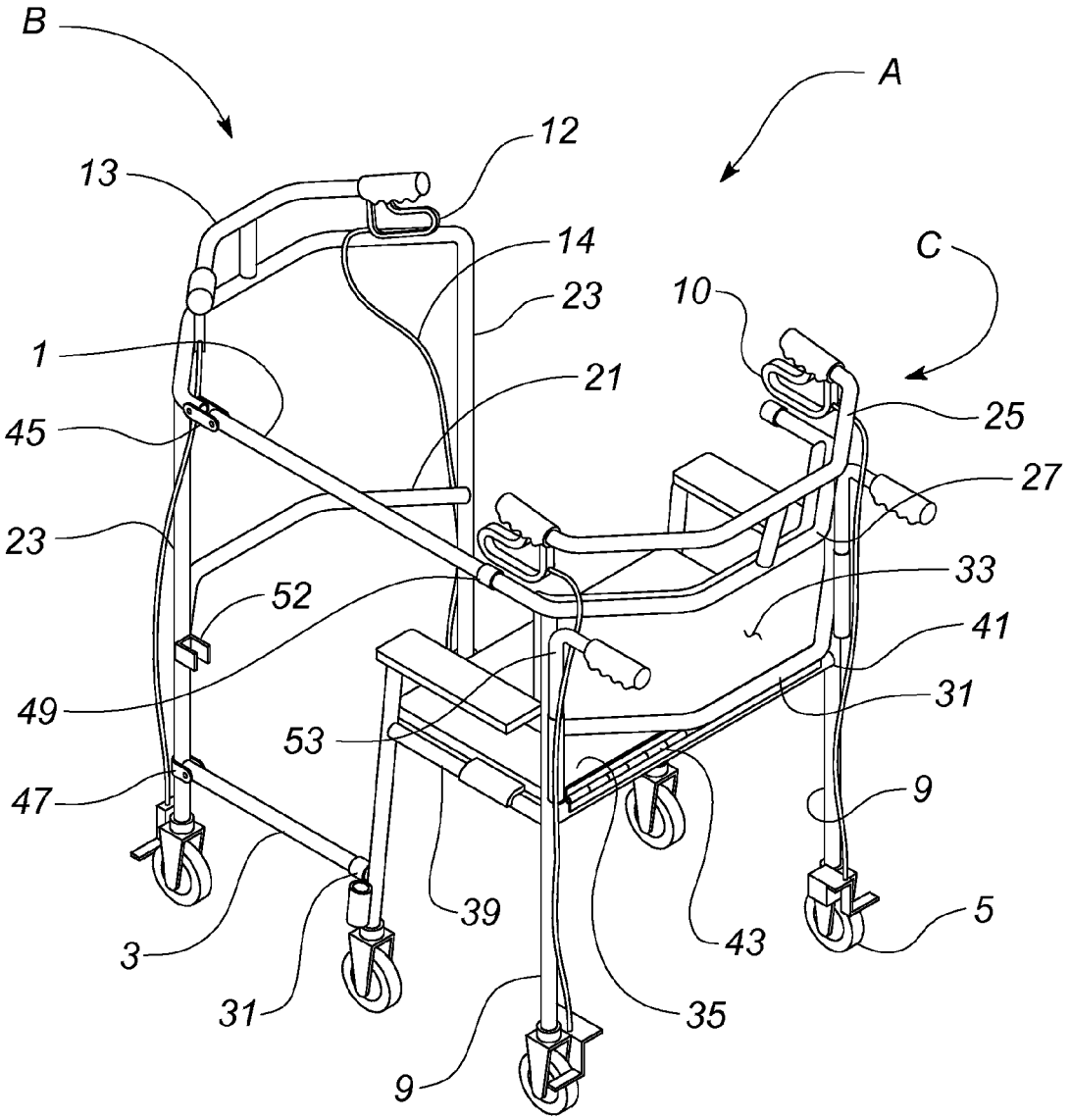
FIG. 2 shows a rear perspective view of one embodiment of the present invention.
Figure 3:
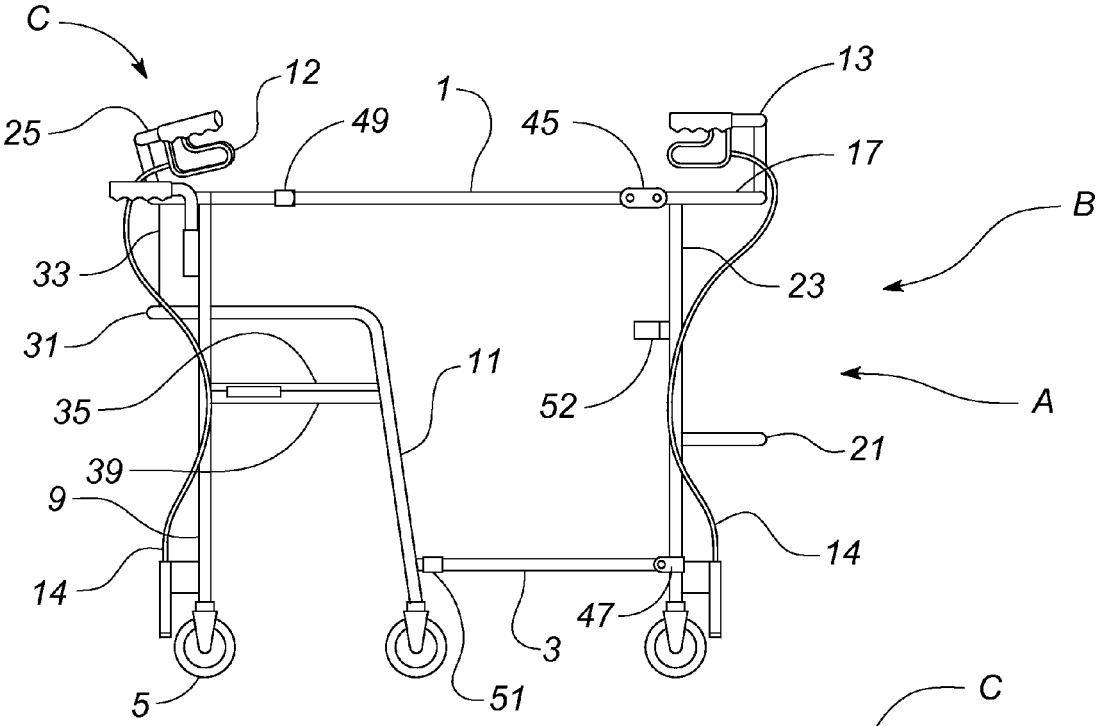
FIG. 3 shows left side view of one embodiment of the present invention.
Figure 4:
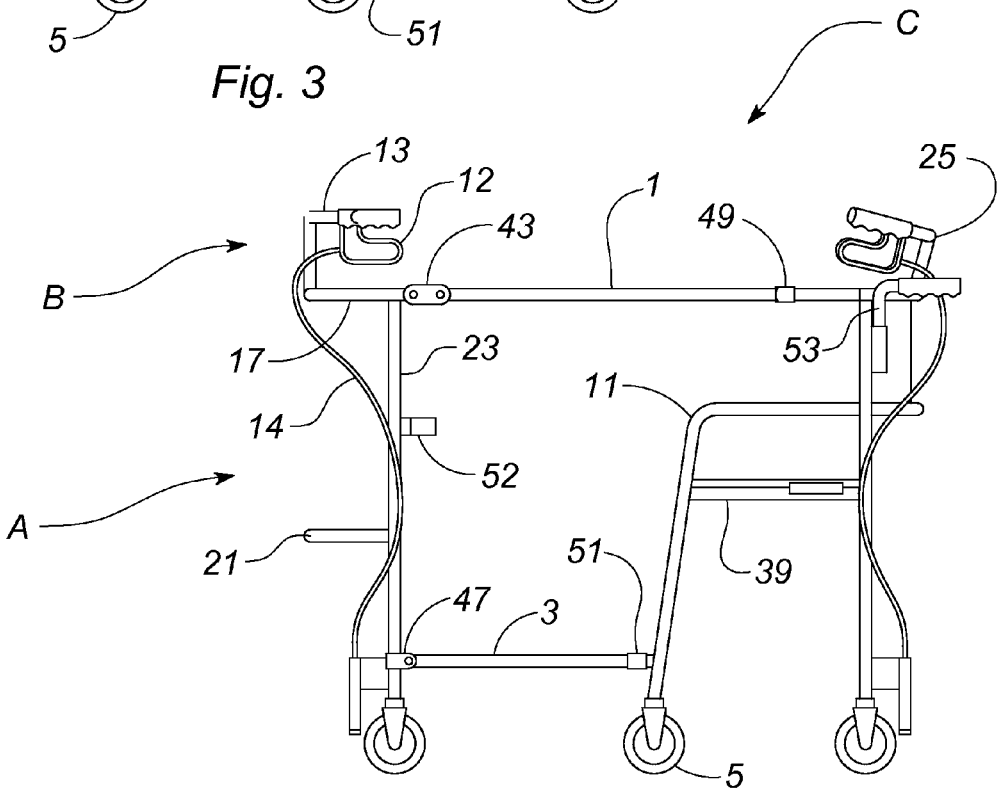
FIG. 4 shows a right side view of one embodiment of the present invention.
Figure 5:
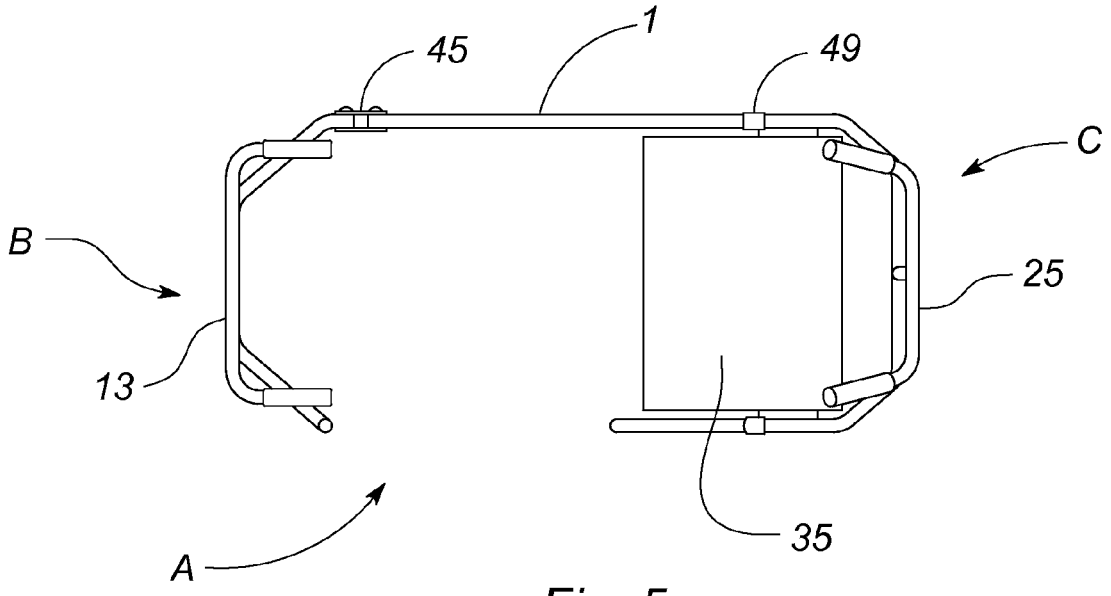
FIG. 5 shows a top view of one embodiment of the present invention.
Figure 6:
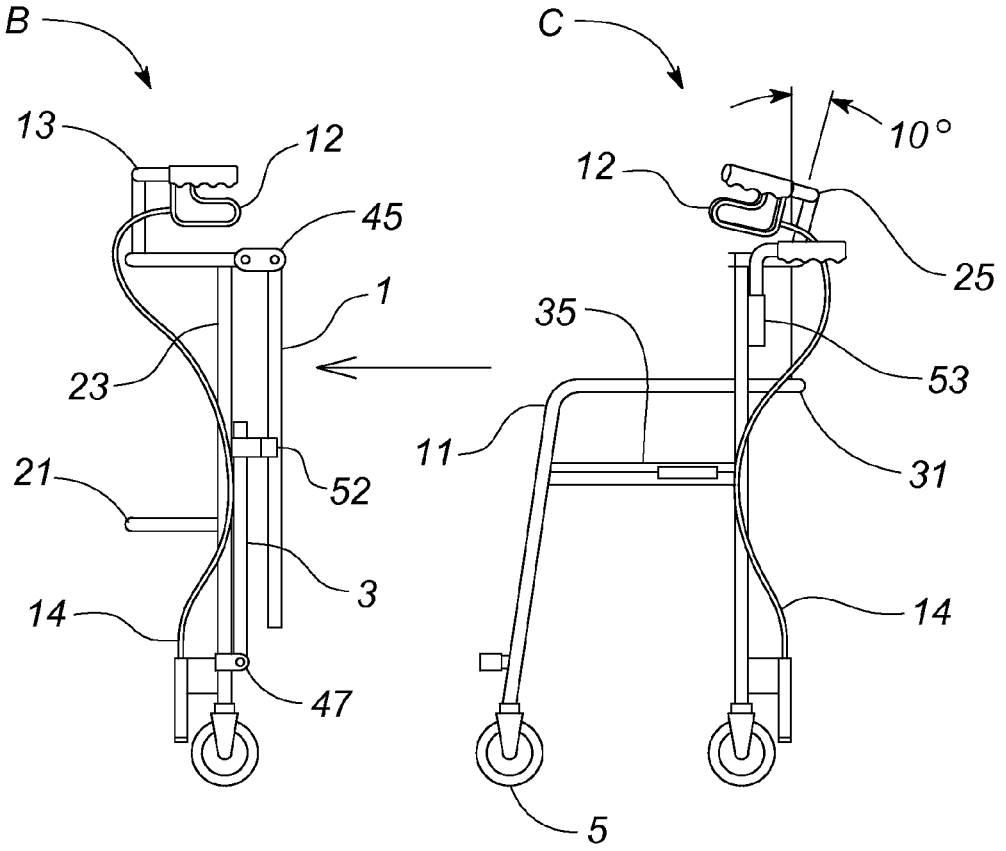
FIG. 6 shows a side of one alternate embodiment of the present invention after it has been separated into its two primary subcomponents.
Figure 7:
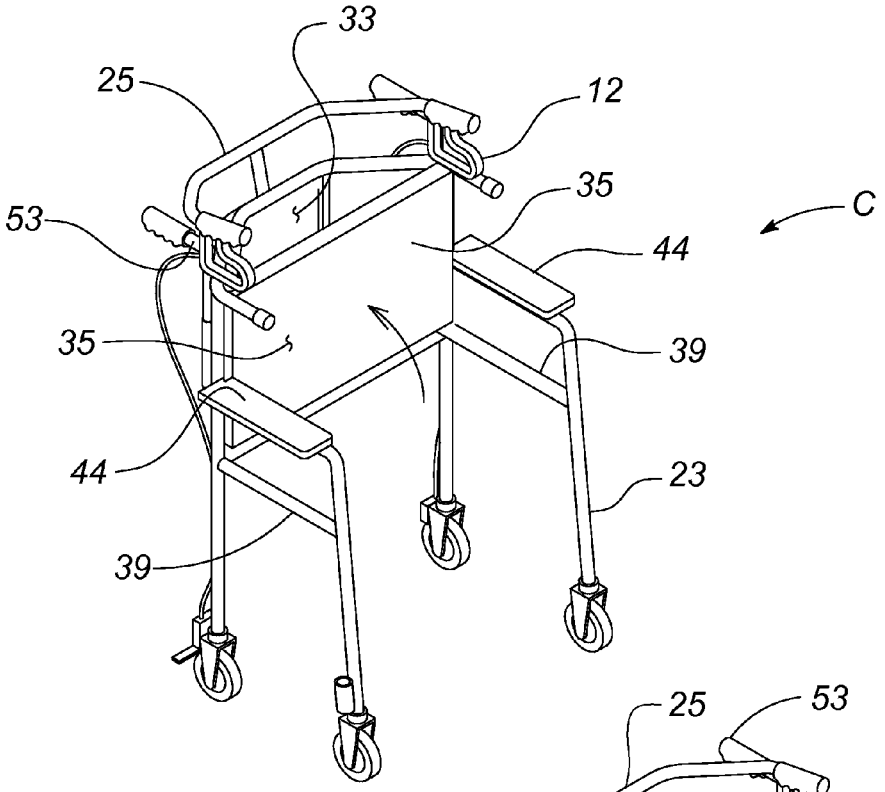
FIG. 7 shows a front perspective view of the wheelchair portion of one embodiment of the present invention after the seat element has been lifted.
Figure 8:
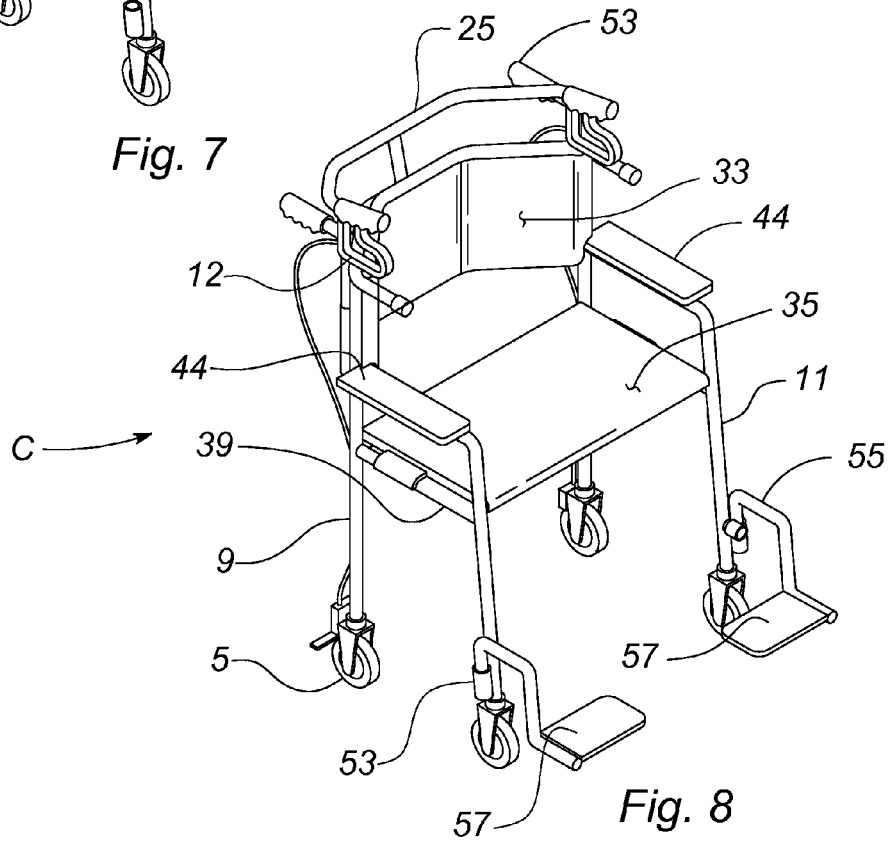
FIG. 8 shows a front perspective view of the wheelchair portion of one embodiment of the present invention with the seat element in a lowered position.

Referring now to the drawings, FIG. 1 and FIG. 2 disclose at least one preferred embodiment of a Multiple Use Ambulatory device A. In this embodiment, the Multiple Use Ambulatory device A comprises a walker portion B and a wheelchair portion C that are generally interconnected by an upper brace 1 and a lower brace 3. A set of wheels 5 are disposed near the bottom tube ends 7 of back leg elements 9 and two arm rest leg elements 11 of the wheelchair portion C, and the vertical support elements 23 of the walker portion B.

In this embodiment, the Multiple Use Ambulatory device A includes a wheel brake mechanism 12 operatively connected to at least two of the set of wheels 5 on the walker portion B and to at least two of the set of wheels 5 on the wheelchair portion C. The wheel brake mechanism 12 is operated by a brake handle 10, two of which are operatively mounted to the walker portion B and the wheel chair portion C. Each of the four wheel brake mechanisms 12 is independently operated. It is understood that the wheel brake mechanisms 12 shown in the present embodiment are generally operated by manipulation of the brake handle 10 varies the tension on brake cable 14 to either engage or disengage the braking action on the certain of the wheels 5. It is also understood that while the wheel brake mechanisms 12 of the present embodiment include brake cables 14, any type of wheel brake mechanism can be used in other embodiments of the present invention as long as the wheel brake mechanism selected can be independently operated to stop or prevent at least one of the set of wheels 5 from rotating.

In the present embodiment, the walker portion B comprises a first frame 2 (FIG. 1) that includes a first handlebar 13 having a handlebar grip 15 at each end of handlebar. The first handlebar 13 is connected to a first upper horizontal bar 17 by a first handlebar rod 19 disposed at about the horizontal midpoint of the first upper horizontal bar 17. A second horizontal bar 21 is disposed between two walker portion seat support vertical bars 23.

The wheelchair portion C of the present embodiment comprises a second frame 4 (FIG. 1) that includes a second handlebar 25 that is connected to a third upper horizontal bar 27 by a second handlebar rod 29. Similar to the first handlebar 13, the second handlebar 25 is disposed on the third upper horizontal bar 27 at about the horizontal midpoint of the third upper horizontal bar, and second handlebar 25 also has a handlebar grip 15 at each end of handlebar.

The second handlebar rod 29 is mounted to the third horizontal bar 27 and the second handlebar 25 such that the transverse horizontal plane of the second handlebar is at an angle of between about 8 degrees and about 12 degrees, and preferably 10 degrees (FIG. 6), in relation to the transverse horizontal plane of the third horizontal bar to tilt the second handlebar forward.

The wheelchair portion C also includes a back 33 (FIG. 1) that is disposed near the third upper horizontal bar 25 and a horizontal back brace 31 (FIG. 2) wherein the horizontal back brace is disposed between each of the two back leg elements 9. It is understood that the back 33 generally relies upon the third horizontal bar 27 and the horizontal back brace 31 to keep the back in a substantially fixed position on the wheelchair portion C.

The wheelchair portion C additionally comprises a seat 35 wherein the sides of the seat are supported by two side seat supports 39 that are disposed between the two back leg elements 9. The rear edge 41 of the seat 35 is rotatably connected to a rear seat support 41 by a seat hinge 43 that allows the seat to be generally rotated upward and backward until the seat is near the back 33. Once positioned in that manner, the seat 33 can be held in that position by one of a wide variety of well-known clips or holders that can be attached to the seat and another component of the wheelchair portion C such that the seat is held in an upward position. An arm rest 44 is mounted upon the upper surface of each of the two horizontal legs of the arm rest leg portions 11. In alternative embodiments, a cushion can be used in conjunction with the seat 35, the back 33, or the arm rest 44 to provide additional comfort for the user of the Multiple Use Ambulatory device A.

The upper brace 1 and the lower brace 3 are used to operatively connect the walker portion B with the wheelchair portion C. As shown in FIG. 2, the distal end of the upper brace 1 is connected to the walker portion B with an upper hinge 45 and the distal end of the lower brace 3 is connected to the walker portion B with a lower hinge 47. The proximate end of the upper brace 1 is connected to the wheelchair portion C with an upper connector 49 and the proximate end of the lower brace 3 is connected to the wheelchair portion C with a lower connector 51. It is understood that the upper connector 49 is intended to fixedly connect the proximate end of the upper brace 1 to the third horizontal bar 27, and the lower connector 50 is intended to fixedly connect the proximate end of the lower brace 3 to the arm rest leg elements 11 of the wheelchair portion C. It will be appreciated by those of skill in the art that there are a wide range of connectors that can used as the upper connector 49 and the lower connector 51 depending on the type of material used in the manufacture of the arm rest leg elements and the third horizontal bar 27, and that any type of connector may be used as long as the connector selected fixedly attaches the proximate ends of the upper brace 1 and the lower brace 3 to the third horizontal bar and the arm rest leg elements 11. After the upper brace 1 and the lower brace 3 have been disconnected from the upper connector 49 and the lower connector 51, the upper brace can be rotated downward and the lower brace can be rotated upward to engage the upper and lower braces with at least one gripper 52 (FIG. 6) that can be mounted to each of the two walker portion vertical bars 23. This allows the upper brace 1 and the lower brace 3 to be retained with the walker portion B to prevent loss or damage to the upper brace or the lower brace.

The wheelchair portion C also includes a set of push handles 53 wherein one push handle is mounted to each of the back leg elements 9. Each push handle includes a handlebar grip 15 mounted to an end of the push handle. A footplate mount 55 is mounted near the bottom of each of the two arm rest leg elements 11 to allow the optional addition of wheelchair footplates to the Multiple Use Ambulatory device A when the wheelchair portion C has been disconnected from the walker portion B to allow the wheelchair portion to be used as a wheelchair. In the present embodiment, the footplate mount 55 is a tube having an inside diameter that is sized and configured to match the mounting rod of a standard wheelchair footplate.

In operation, the Multiple Use Ambulatory device A (FIG. 1) has at least three modes of operation. In a first mode of operation, the walker portion B is connected to the wheelchair portion C. In this mode of operation, the Multiple Use Ambulatory device A can be used by a person having unstable walking or standing abilities. The user can stand in the area between the walker portion B and the wheelchair portion C facing the walker portion. As the user walks, the user rests their hands on the first handlebar 13 and then, while walking in the direction of the walker portion B, walks forward while pushing the Multiple Use Ambulatory device A. If the user determines that they are in danger of falling, the user can easily fall backward onto the seat 35 of the wheelchair portion C to prevent the user from falling. After recovering, the user can then move to a standing position using the first handlebar 13 to assist the user in rising and moving into a stable standing position. Alternatively, the device can be moved forward by others to meet the user when the user is falling.

If the user has more stability, the second mode of operation can assist the user while walking. In this mode, the walker portion B (FIG. 6) is disengaged from the wheelchair portion B by disconnecting the upper brace 1 from the upper connector 49 and disconnecting the lower brace 3 from the lower connector 51. The upper brace 1 and the lower brace 3 are then positioned into the gripper 52 to stow the upper brace and the lower brace out of the way. The seat 35 (FIG. 7) is raised upward from two side front seats supports 39 until the front edge of the seat is located near the upper are of the back 33. Then, as in the first mode of operation, the user can stand in the area between the walker portion B and the wheelchair portion C facing the wheelchair portion. As the user walks, the user rests their hands on the second handlebar 25 and then, while walking in the direction of the wheelchair portion C, walks forward while pushing the wheelchair portion in front of the user. It is understood that in this embodiment, the seat hinge 43 (FIG. 2) has enough friction between the leaves of the hinge that when the seat 35 is raised, the friction is enough to inhibit the seat from returning to its lowered position resting upon the two side seat supports 39. In other embodiments of the present invention, additional holding clips can be mounted to the wheelchair portion C such that the holding clips can operatively attach to the seat 35 and prevent to inhibit the seat from returning to its lowered position resting upon the two side seat supports 39. After the upper brace 1 (FIGS. 5 & 6) and the lower brace 3 have been disconnected from the walker portion B, and the seat 35 has been placed in its raised position, the user can then face in the direction of the wheelchair portion C and walk forward—using the second handlebar 25 as support and the wheel brake mechanism 12, if necessary, to stop the wheelchair portion C from moving forward. If the user becomes tired or unstable, the user can stop the wheelchair portion C, rotate the seat 35 downward until the seat rests upon the two side seat supports 39, and then turn around to sit down on the seat for a period of rest.

In the third mode of operation, the wheelchair portion C is disconnected from the walker portion B (FIG. 8) and the wheelchair portion is used as a wheelchair. In this mode, the walker portion B is disengaged from the wheelchair portion B by disconnecting the upper brace 1 (FIG. 3) from the upper connector 49 and disconnecting the lower brace 3 from the lower connector 51. The upper brace 1 and the lower brace 3 are then positioned into the gripper 52 to stow the upper brace and the lower brace out of the way. The seat 35 (FIG. 8) remains in its lowered position resting upon the two side seat supports 39. A user can then sit down upon the seat 35 and a second person can move the user while sitting in the wheelchair portion C by gripping the handlebar grips 15 mounted on the two push handles 53 and push the wheelchair portion C forward or backward as needed. If the user needs additional support to lift the user's feet from the floor while the second person is pushing the wheelchair portion C, standard wheelchair footplates 57 can be inserted into two footplates mounts 55 mounted to the lower portion of each of the arm rest leg supports 11.

In a preferred embodiment, the frames elements of the first frame and the second frame are made from a tubular material and formed as needed to match the configurations for each frame element described herein. It is understood that in this preferred embodiment, the tubular material is made from a lightweight material such as aluminum. It will be appreciated by those of skill in the art, however, that the frame elements may be made from any material as long as the material selected has enough strength to support a user as described in the operations of the some embodiments of the present invention.

It will be appreciated by those of skill in the art that the above embodiments, as well as other alternative embodiments of the present invention, may include the incorporation of any number of hinges operatively connected to various components of those embodiments to allow the folding of any component of the multiple use ambulatory device for easier transportation. As one example, back leg elements 9, arm rest leg elements 11, or the walker portion vertical bars 23 may have foldable hinges that would allow those components to be folded to reduce the overall length of those components to allow for easier storage or shipping. It is understood that yet other components of the multiple use ambulatory device could be modified to include similar hinges. It is also understood that the term "hinges" is intended to include any device or mechanism that allows any component of the multiple use ambulatory device to be reoriented in a manner that allows for better storing or transportation. Finally, it is also understood that any component of the multiple use ambulatory device can be modified in other ways to enhance the storage or transportability of the device. For example, in lieu of hinges, the component may also be made in two or more segments that can be assembled together to generate the component as it is described and used herein.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

Additionally, it will be seen in the above disclosure that the several intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A multiple use ambulatory device comprising:

a walker portion detachably connected to a wheelchair portion with an upper brace and a lower brace that are one of either partially detachable or fully detachable from one of either the walker portion or the wheelchair portion wherein a distal end of the upper brace is connected to the walker portion with an upper hinge and a distal end of the lower brace is connected to the walker portion with a lower hinge, and wherein a proximate end of the upper brace is connected to the wheelchair portion with an upper connector and a proximate end of the lower brace is connected to the wheelchair portion with a lower connector;

wherein the walker portion includes a first frame to which a first handlebar and a set of at least two wheels are mounted;

wherein the wheelchair portion includes a second frame to which a back, a hinged seat, a second handlebar, and a set of at least four wheels are mounted; and, wherein the wheelchair portion includes at least one push handle.

2. The multiple use ambulatory device of claim 1 further comprising at least one wheel brake mechanism operatively connected to at least two of the set of four wheels on the wheelchair portion, and a wheel brake mechanism operatively connected to each of the two wheels on the walker portion.

3. The multiple use ambulatory device of claim 2 wherein the wheel brake mechanism is operated by a brake handle and wherein each of the wheel brake mechanisms is independently operated.

4. The multiple use ambulatory device of claim 3 further comprising a handlebar grip at each of the first handlebar and the second handlebar.

5. The multiple use ambulatory device of claim 4 further wherein the first frame for the walker portion includes a first upper horizontal bar disposed between two walker portion vertical bars, a first handlebar rod disposed between the first handlebar and the first upper horizontal bar, and a second horizontal bar disposed between the two walker portion vertical bars.

6. The multiple use ambulatory device of claim 5 further wherein the second frame for the wheelchair portion includes a third horizontal bar disposed between two back leg elements, a horizontal back brace also disposed between the two back leg elements, a rear seat support disposed between the two back leg elements.

7. The multiple use ambulatory device of claim 6 wherein the transverse horizontal plane of the second handlebar is at an angle of between about 8 degrees and about 12 degrees in relation to the transverse horizontal plane of the third horizontal bar.

8. The multiple use ambulatory device of claim 7 wherein the transverse horizontal plane of the second handlebar is at an angle of 10 degrees in relation to the transverse horizontal plane of the third horizontal bar.

9. The multiple use ambulatory device of claim 8 wherein the back is disposed near the third upper horizontal bar and the horizontal back brace.

10. The multiple use ambulatory device of claim 9 wherein the wheelchair portion further comprises an arm rest mounted upon an upper surface of each of two horizontal legs of an arm rest leg portion.

11. The multiple use ambulatory device of claim 10 wherein the wheelchair portion includes two push handles wherein one push handle is mounted to each of the back leg elements.

12. The multiple use ambulatory device of claim 11 further comprising a handlebar grip mounted to each push handle.

13. The multiple use ambulatory device of claim 12 further comprising a footplate mount mounted near the bottom of each of the two arm rest leg elements.

14. A multiple use ambulatory device comprising:

a walker portion detachably connected to a wheelchair portion with an upper brace and a lower brace that are one of either partially detachable or fully detachable from one of either the walker portion or the wheelchair portion wherein a distal end of the upper brace is connected to the walker portion with an upper hinge and a distal end of the lower brace is connected to the walker portion with a lower hinge, and wherein a proximate end of the upper brace is connected to the wheelchair portion with an upper connector and a proximate end of the lower brace is connected to the wheelchair portion with a lower connector;

a first frame of the walker portion to which a first handlebar and a set of at least two wheels are mounted wherein the wheelchair portion includes a second frame to which a back, a hinged seat, a second handlebar, and a set of at least four wheels are mounted, and wherein the wheelchair portion includes at least one push handle;

at least one wheel brake mechanism operatively connected to at least two of the set of four wheels on the wheelchair portion;

a wheel brake mechanism operatively connected to each of the two wheels on the walker portion wherein the wheel brake mechanism is operated by a brake handle and wherein each of the wheel brake mechanisms is independently operated;

a handlebar grip at each of the first handlebar and the second handlebar.

a first upper horizontal bar for the walker portion disposed between two walker portion vertical bars, a first handlebar rod disposed between the first handlebar and the first upper horizontal bar, and a second horizontal bar disposed between the two walker portion vertical bars;

wherein the second frame for the wheelchair portion includes a third horizontal bar disposed between two back leg elements, a horizontal back brace also disposed between the two back leg elements, a rear seat support disposed between the two back leg elements;

wherein the wheelchair portion includes two push handles wherein one push handle is mounted to each of the back leg elements;

wherein the transverse horizontal plane of the second handlebar is at an angle of between about 8 degrees and about 12 degrees in relation to the transverse horizontal plane of the third horizontal bar; and wherein the back is disposed near the third upper horizontal bar and the horizontal back brace.

15. The multiple use ambulatory device of claim 14 further comprising a handlebar grip mounted to each push handle.

16. The multiple use ambulatory device of claim 15 further comprising a footplate mount mounted near the bottom of each of the two arm rest leg elements.

* * * * *